US007609241B2

(12) United States Patent
Chen et al.

(10) Patent No.: US 7,609,241 B2
(45) Date of Patent: Oct. 27, 2009

(54) DOUBLE-FACED LIGHT EMITTING DIODE DISPLAY

(75) Inventors: Pi-Jin Chen, Beijing (CN); Peng Liu, Beijing (CN); Li Qian, Beijing (CN); Yang Wei, Beijing (CN); Lei-Mei Sheng, Beijing (CN); You-Hua Lei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 772 days.

(21) Appl. No.: 11/168,221

(22) Filed: Jun. 28, 2005

(65) Prior Publication Data

US 2006/0001625 A1 Jan. 5, 2006

(30) Foreign Application Priority Data

Jul. 2, 2004 (CN) ..... 2004 1 0027984

(51) Int. Cl.
*G09G 3/32* (2006.01)

(52) U.S. Cl. ..... 345/83

(58) Field of Classification Search ..... 345/5, 345/7, 76–83, 690, 695; 348/51–60; 359/376, 359/462

See application file for complete search history.

(56) References Cited

U.S. PATENT DOCUMENTS 5,688,551 A * 11/1997 Littman et al. ..... 427/64
5,714,838 A * 2/1998 Haight et al. ..... 313/506
6,890,782 B2 * 5/2005 Yamada ..... 438/29
2003/0227254 A1 * 12/2003 Terumoto ..... 313/504
2004/0217681 A1 * 11/2004 Park et al. ..... 313/110
2005/0207156 A1 * 9/2005 Wang et al. ..... 362/240

FOREIGN PATENT DOCUMENTS

CN 1112663 C 6/2003
CN 1165880 C 9/2004

* cited by examiner

*Primary Examiner*—Richard Hjerpe
*Assistant Examiner*—Robert E Carter, III
(74) *Attorney, Agent, or Firm*—D. Austin Bonderer

(57) ABSTRACT

A double-faced light emitting diode display includes a pair of parallel shield panels (20, 20'), and a light emitting module (30) located between the shield panels. Each shield panel includes a video contrast enhancement assembly. The light emitting module includes an opaque insulative substrate (31) with a pair of pixel matrixes symmetrically formed on opposite surfaces (310, 310') thereof and a circuit driving system formed at at least one of the surfaces. Each pixel matrix includes a plurality of pixel units (320, 320'). Symmetrically opposite pairs of pixel units are electrically interconnected so that the shield panels can simultaneously display same images. The double-faced light emitting diode display has a simple structure, a small size, low cost and full color display capability, and can be advantageously applied in traffic signal boards, large-scale display boards, surround cinemas and so on.

8 Claims, 4 Drawing Sheets

DOUBLE-FACED LIGHT EMITTING DIODE DISPLAY

BACKGROUND OF THE INVENTION

The invention relates generally to double-faced display devices, and more particularly to a kind of double-faced light emitting diode display.

Today, flat panel technologies are in widespread use in computers, mobile communications, consume electrical products, and so on. Light emitting diodes have generally been recognized as good light sources for flat panel displays for a number of reasons. These include their solid state operation, their capability to be made relatively small (thus potentially increasing resolution), and their potential for yielding relatively low manufacturing costs. A flat panel display adopting light emitting diodes is called a light emitting diode display.

FIGS. 6 and 7 represent a conventional light emitting diode display disclosed in China patent no. 96199365.0. The light emitting diode display 10 includes a printed circuit board (PCB) 12, a shield panel 13, and a bracket 16. A plurality of pixel units 11 are formed on a surface (not labeled) of the PCB 12 that faces the shield panel 13, and a circuit driving system 19 is formed on an opposite surface (not labeled) of the PCB 12 that faces the bracket 16. The PCB 12, the shield panel 13 and the circuit driving system 19 are fixed into a whole unit by a pin 17. The circuit driving system 19 includes a row driver and a column driver. Each pixel unit 11 includes three light emitting diodes having three optical primary colors (i.e., R (red), G (green) and B (blue) respectively), a common anode electrically connected with each of the three light emitting diodes, and three cathodes electrically connected with the three light emitting diodes respectively. The row driver is connected with the common anode to drive the common anode to switch the circuit of the pixel unit on or off, and the column driver is connected with the cathodes to drive the cathodes to control the brightnesses of the light emitting diodes, whereby a color displayed by the pixel unit is controlled.

When a video signal is input to the light emitting diode display 10, the row driver drives the common anodes of the relevant pixel units 11 to switch the circuits of the relevant pixel units 11 on according to the video signal. Simultaneously, the column driver drives the cathodes of the relevant pixel units 11 to control the brightnesses of the light emitting diodes according to the video signal. In this way, colors displayed by the relevant pixel units 11 are controlled according to the video signal. Thus, a video image according to the video signal is displayed on the shield panel 13.

In the light emitting diode display 10, only a single image is displayed on the shield panel 13. However, in certain applications, simultaneously displaying of images at two opposite sides of the light emitting diode display 10 is required. In order to meet such needs, China patent no. 02123762.X discloses a double-faced light emitting diode display. As shown in FIG. 7, the double-faced light emitting diode display includes an enclosure, and a light emitting module packed in the enclosure. The enclosure includes a front portion 1, a front transparent protecting film 8, a back portion 2, and a back transparent protecting film 3. The light emitting module includes a light guide plate 6, a pair of astigmatism layers 9, 4 formed on opposite surfaces of the light guide plate 6, and a pair of light emitting diodes 7 located at opposite side extremities of the light guide plate 6.

In use, the light emitting diodes 7 emit light having a single color, and the colored light passes through the light guide plate 6 and the astigmatism layers 9, 4. Thus, a pair of colored signs can be displayed on the transparent protecting films 8, 3 respectively.

However, the double-faced light emitting diode display can only display simple signs having a single color. Such display can be used in traffic signal boards and certain limited applications only, and cannot be used for applications requiring large-scale full color displays.

What is needed, therefore, is a double-faced light emitting diode display having full color display capability. Desirably, the double-faced light emitting diode display would also have a simple structure, small bulk, and low cost.

SUMMARY

In a preferred embodiment, a double-faced light emitting diode display includes a pair of parallel shield panels, and a light emitting module located between the shield panels. Each shield panel includes a video contrast enhancement assembly. The video contrast enhancement assembly includes a plurality of video contrast enhancement units. The light emitting module includes an opaque insulative substrate with a pair of pixel matrixes symmetrically formed on opposite surfaces thereof and a circuit driving system formed at at least one of the surfaces. Each pixel matrix includes a plurality of pixel units. Each pixel unit corresponds to one respective corresponding video contrast enhancement unit and includes three light emitting diodes having three optical primary colors, i.e., R (red), G (green) and B (blue) respectively, a common anode electrically connected with each of the three light emitting diodes and three cathodes electrically connected with the three light emitting diodes respectively. The circuit driving system includes a row driver and a column driver located near edges of two adjacent sides of the surface of the opaque insulative substrate. The row driver is electrically connected with the common anodes of the pixel units in parallel and the column driver is electrically connected with the cathodes of the pixel units in parallel.

Each pair of pixel units which are located at a same row and are axially symmetrical to each other across an imaginary center line of the opaque insulative substrate are electrically interconnected. Thus, the shield panels can simultaneously display same images.

Compared with a conventional double-faced light emitting diode display, the double-faced light emitting diode display of the preferred embodiment adopts a pair of shield panels and a single driving system to simultaneously display same images at the two shield panels. Therefore, the double-faced light emitting diode display has a simple structure, a small size, low cost, and full color display capability. This enables the light emitting diode display to be advantageously applied in traffic signal boards, large-scale display boards, surround cinemas, and so on.

Other advantages and novel features will become more apparent from the following detailed description of preferred embodiments when taken in conjunction with the accompanying drawings, in which:

DETAILED DESCRIPTION OF PREFERRED EMBODIMENTS

Reference will now be made to the drawings to describe preferred embodiments of the present invention in detail.

Figure 1:
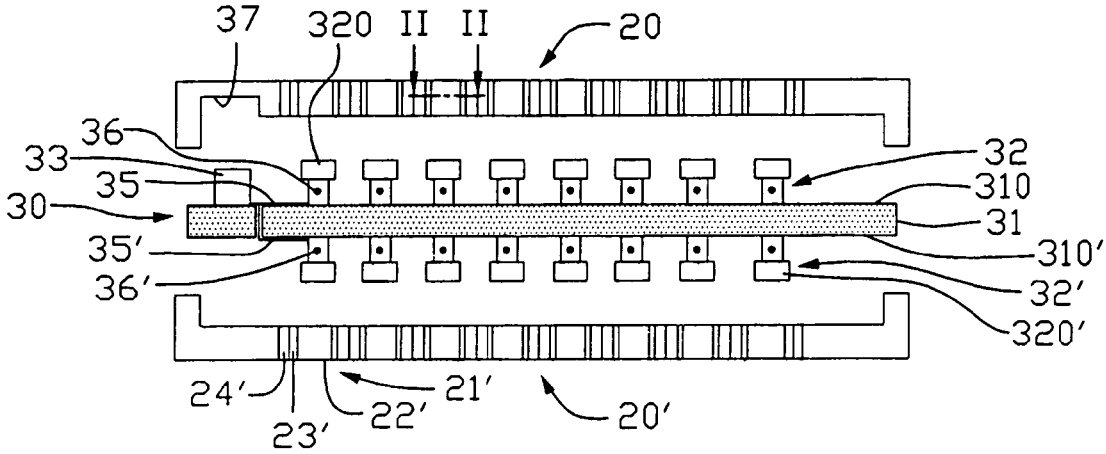
FIG. 1 is a simplified, schematic, side cross-sectional view of a double-faced light emitting diode display in accordance with a preferred embodiment of the present invention.
Figure 2:
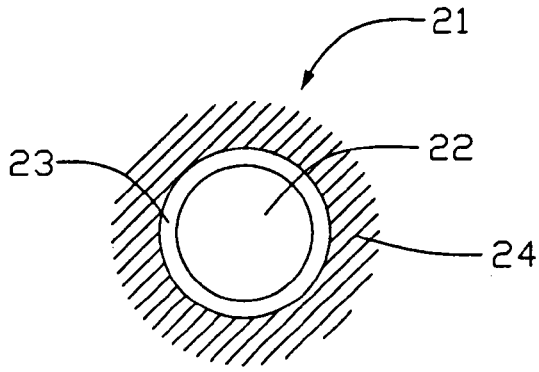
FIG. 2 is an enlarged, schematic cross-sectional view of a video contrast enhancement unit of FIG. 1, taken along line II-II thereof.
Figure 3:
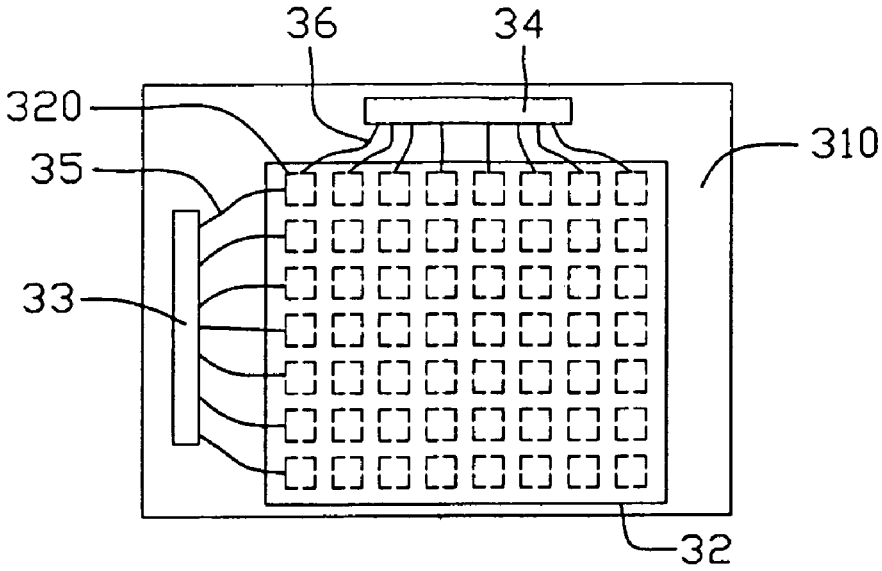
FIG. 3 is a schematic, top view of a light emitting module on an opaque insulative substrate of the double-faced light emitting diode of FIG. 1, showing a pixel matrix including a plurality of pixel units electrically connected with a row driver and a column driver.

Referring to FIGS. 1, 2 and 3, a double-faced light emitting diode display in accordance with a preferred embodiment of the present invention is shown. The double-faced light emitting diode display includes two parallel shield panels 20, 20', and a light emitting module 30 located between the shield panels 20, 20'. The shield panel 20 includes a video contrast enhancement assembly. The video contrast enhancement assembly includes a plurality of video contrast enhancement units 21. Each video contrast enhancement unit 21 is columnar, and includes a white reflecting portion 23 surrounding a through hole 22 and a dark portion 24 around the white reflecting portion 23. Similarly, the shield panel 20' includes a video contrast enhancement assembly. The video contrast enhancement assembly includes a plurality of video contrast enhancement units 21'. Each video contrast enhancement unit 21' is columnar, and includes a white reflecting portion 23' surrounding a through hole 22' and a dark portion 24' around the white reflecting portion 23'.

The light emitting module 30 includes an opaque insulative substrate 31 having two opposite surfaces 310, 310'. The surface 310 has a pixel matrix 32 and a circuit driving system formed thereon. The pixel matrix 32 includes a plurality of pixel units 320, and each pixel unit 320 is received in the through hole 22 of one corresponding video contrast enhancement unit 21. The circuit driving system includes a row driver 33 and a column driver 34 located near edges of two adjacent sides of the surface 310 of the opaque insulative substrate 31. Correspondingly, two separate recesses 37 are formed in the shield panel 20 for receiving the row driver 33 and the column driver 34. The row driver 33 and the column driver 34 can be field effect transistors. Similar, the surface 310' has a pixel matrix 32' formed thereon. The pixel matrix 32' includes a plurality of pixel units 320', and each pixel unit 320' is received in the through hole 22' of one corresponding video contrast enhancement unit 21'.

Because of the opaque insulative substrate 31, a first light emitting area (not labeled) is defined between the shield panel 20 and the light emitting module 30, and a second light emitting area (not labeled) is defined between the shield panel 20' and the light emitting module 30. The first and second light emitting areas are independent of each other.

Figure 4:
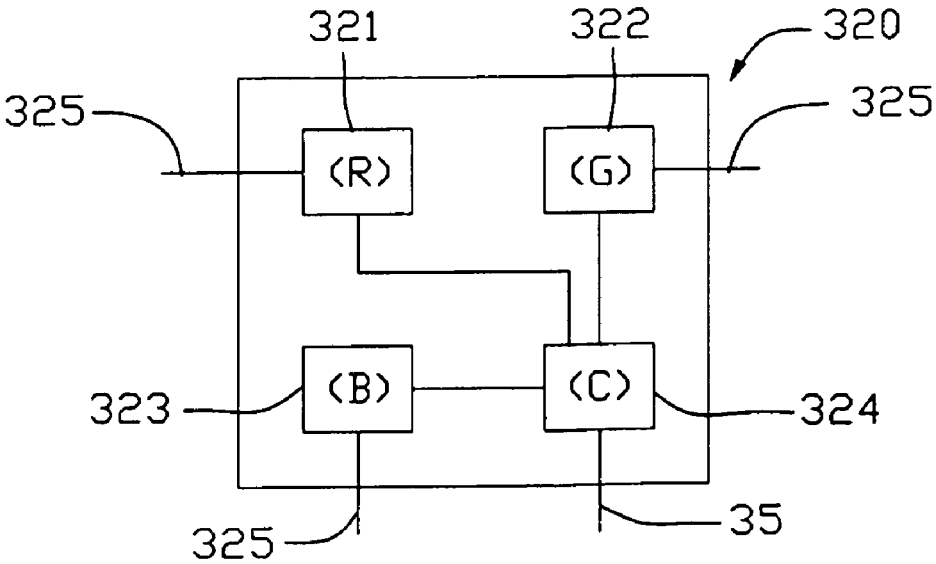
FIG. 4 is an enlarged, schematic, top view of one pixel unit of the pixel matrix shown in FIG. 3, showing three light emitting diodes having three optical primary colors R (red), G (green) and B (blue), a common anode connected with each of the three light emitting diodes, and three cathodes connected with the light emitting diodes respectively.

Referring to FIG. 4, one pixel unit 320 is shown. The other pixel units 320 and the pixel units 320' have a same structure as that of the pixel unit 320 shown. The pixel unit 320 includes: three light emitting diodes 321, 322, 323 having three optical primary colors, i.e., R (red), G (green), B (blue) respectively; a common anode 324 electrically connected with each of the three light emitting diodes 321, 322, 323; and three cathodes 325 electrically connected with the three light emitting diodes 321, 322, 323 respectively. The pixel unit 320 also includes an anode lead 35 electrically connected with the common anode 324, and three cathode leads 36 electrically connected with the three cathodes 325 respectively.

Referring to FIG. 3, the row driver 33 is electrically connected with the common anodes 324 of the pixel units 320 in parallel. That is, the anode lead 35 of each pixel unit 320 is electrically connected with the row driver 33, and therefore the common anode 324 is electrically connected with the row driver 33. The column driver 34 is electrically connected with the cathodes 325 of the pixel units 320 in parallel. That is, the cathode leads 36 of each pixel unit 320 are connected with the column driver 34, and therefore the cathodes 325 are electrically connected with the column driver 34. The row driver 33 is used to drive the common anode 324 to switch the circuit of each pixel unit 320 on or off, and the column driver 34 is used to drive the cathodes 325 to control the brightnesses of the light emitting diodes 321, 322, 323.

Figure 5:
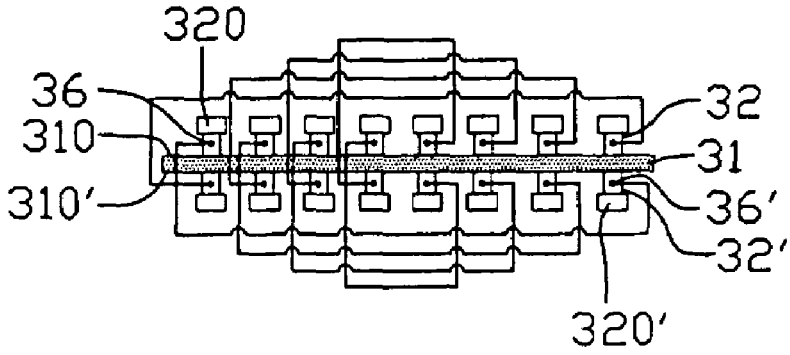
FIG. 5 is a schematic, side plan view of the opaque insulative substrate and pixel units of the double-faced light emitting diode of FIG. 1, showing electrical connections of the pixel units.
Figure 6:
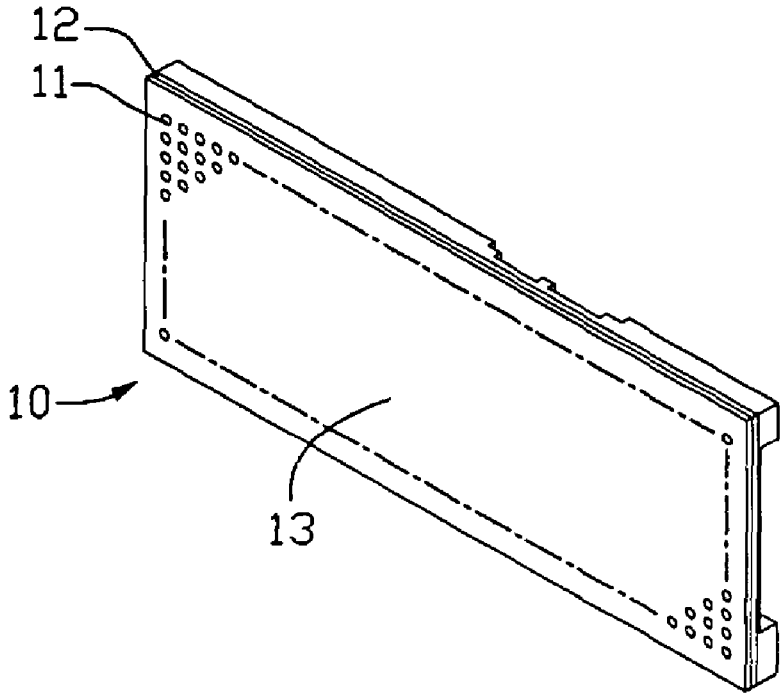
FIG. 6 (PRIOR ART)
FIG. 6 is a simplified, isometric representation of a conventional light emitting diode display.
Figure 7:
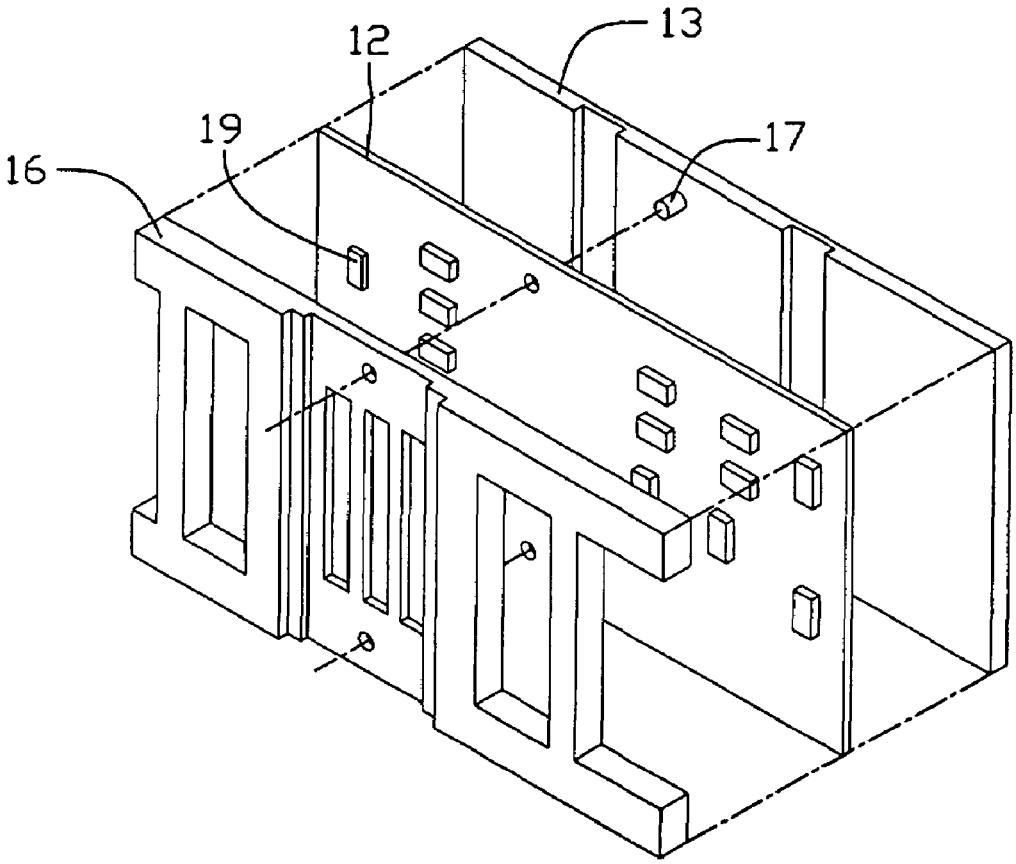
FIG. 7 (PRIOR ART)
FIG. 7 is an exploded representation of the light emitting diode display of FIG. 6, but viewed from another aspect.
Figure 8:
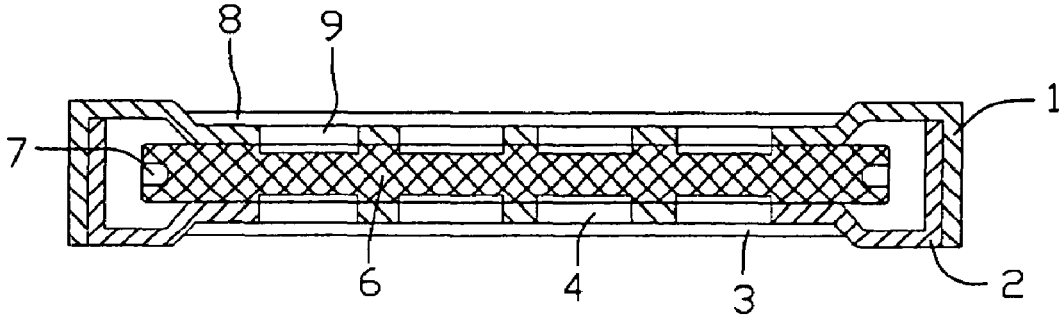
FIG. 8 (PRIOR ART)
FIG. 8 is a simplified, cross-sectional representation of a conventional double-faced light emitting diode display.

FIG. 5 is a schematic diagram showing electrical connections of the pixel units 320, 320'. In the preferred embodiment, a first row and a first column of pixel units 320 of the surface 310 are defined as coinciding with and being located directly opposite a first row and a first column of pixel units 320' of the surface 310'. Similarly, a last row and a last column of pixel units 320 of the surface 310 are defined as coinciding with and being located directly opposite a last row and a last column of pixel units 320' of the surface 310'. The pixel unit 320 located at a first row and a first column of the surface 310 and the pixel unit 320' located at a first row and a last column of the surface 310' are axially symmetrical to each other across an imaginary center line of the opaque insulative substrate 31, and are electrically interconnected. That is, the anode lead 35 of the pixel unit 320 is connected with the anode lead 35' of the pixel unit 320', the cathode lead 36 connected with the light emitting diode 321 of the pixel unit 320 is electrically connected with the cathode lead 36' connected with the light emitting diode 321' of the pixel unit 320', the cathode lead 36 connected with the light emitting diode 322 of the pixel unit 320 is electrically connected with the cathode lead 36' connected with the light emitting diode 322' of the pixel unit 320', and the cathode lead 36 connected with the light emitting diode 323 of the pixel unit 320 is electrically connected with the cathode lead 36' connected with the light emitting diode 323' of the pixel unit 320'. Similarly, other pairs of pixel units 320, 320' that are located at a same row and are axially symmetrical to each other across the imaginary center line of the opaque insulative substrate 31 are interconnected in like manner to that described above.

When a video signal is input to the double-faced light emitting diode display, the row driver 33 drives the common anodes 324, 324' of relevant pairs of pixel units 320, 320' to switch the circuits of the relevant pairs of pixel units 320, 320' on according to the video signal. Simultaneously, the column driver 34 drives the cathodes 325, 325' of the relevant pairs of pixel units 320, 320' to control the brightnesses of the light emitting diodes 321, 322, 323 according to the video signal. In this way, colors displayed by the relevant pairs of pixel units 320, 320' are controlled according to the video signal. Thus, a pair of identical video images according to the video signal are displayed on the shield panels 20, 20' respectively. Furthermore, the corresponding video contrast enhancement units 21, 21' of the relevant pairs of pixel units 320, 320' can enhance the video contrast of the video images. This is achieved by absorbing of emitted light by the dark portions 24, 24', and by reflecting of emitted light by the white reflecting portions 23, 23'.

Compared with a conventional double-faced light emitting diode display, the double-faced light emitting diode display of the preferred embodiment adopts a pair of shield panels and a single driving system to simultaneously display same images at the two shield panels. Therefore the double-faced light emitting diode display has a simple structure, a small size, low cost, and full color display capability. This enables the double-faced light emitting diode display to be advantageously applied in traffic signal boards, large-scale display boards, surround cinemas, and so on.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

We claim:

1. A double-faced light emitting diode display comprising:

a pair of shield panels, each shield panel comprising a video contrast enhancement assembly; and a light emitting module located between the shield panels, the light emitting module comprising an opaque insulative substrate with a pair of pixel matrixes provided at two main surfaces thereof and a circuit driving system provided on at least one of the main surfaces, each pixel matrix corresponding to a respective opposite video contrast enhancement assembly and comprising a plurality of pixel units, wherein each of pairs of pixel units is defined as one pixel unit in a row of one of the pixel matrixes and another pixel unit in a same row of the other pixel matrix, and symmetrically opposite pairs of pixel units are electrically interconnected and are electrically connected with the circuit driving system, wherein each pixel unit comprises three light emitting diodes having optical primary colors R (red), G (green) and B (blue) respectively, a common anode electrically connected with each of the three light emitting diodes, and three cathodes electrically connected with the three light emitting diodes respectively;

wherein the circuit driving system comprises a row driver and a column driver located at two sides of the at least one of the main surfaces;

wherein the row driver is electrically connected with the common anodes of the pixel units in parallel, and the column driver is electrically connected with the cathodes of the pixel units in parallel;

wherein the common anodes of each symmetrically opposite pair of pixel units are electrically interconnected;

wherein the six cathodes of each symmetrically opposite pair of pixel units are electrically interconnected in three corresponding one-to-one relationships.

2. The double-faced light emitting diode display as claimed in claim 1, wherein the row driver and the column driver are field effect transistors.

3. The double-faced light emitting diode display as claimed in claim 1, wherein each video contrast enhancement assembly comprises a plurality of video contrast enhancement units.

4. The double-faced light emitting diode display as claimed in claim 3, wherein each video contrast enhancement unit corresponds to a respective pixel unit.

5. The double-faced light emitting diode display as claimed in claim 4, wherein each video contrast enhancement unit comprises a white reflecting portion surrounding a through hole and a dark portion around the white reflecting portion.

6. The double-faced light emitting diode display as claimed in claim 5, wherein a corresponding pixel unit is received in the through hole.

7. The double-faced light emitting diode display as claimed in claim 1, wherein at least one of the shield panels defines at least one recess for receiving the circuit driving system.

8. The double-faced light emitting diode display as claimed in claim 1, wherein each of the shield panels further comprises two separate recesses defined therein and configured for receiving the row driver and the column driver.

* * * * *

UNITED STATES PATENT AND TRADEMARK OFFICE

CERTIFICATE OF CORRECTION

PATENT NO. : 7,609,241 B2
APPLICATION NO. : 11/168221
DATED : October 27, 2009
INVENTOR(S) : Chen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1156 days.

Signed and Sealed this

Twelfth Day of October, 2010

David J. Kappos

David J. Kappos
*Director of the United States Patent and Trademark Office*